US006320820B1

(12) United States Patent
Gardner et al.

(10) Patent No.: US 6,320,820 B1
(45) Date of Patent: Nov. 20, 2001

(54) HIGH DATA RATE ACOUSTIC TELEMETRY SYSTEM

(75) Inventors: Wallace R. Gardner; Vimal V. Shah, both of Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/400,357

(22) Filed: Sep. 20, 1999

(51) Int. Cl.[7] ..... H04H 9/00

(52) U.S. Cl. ..... 367/81; 367/83; 340/854.4; 340/854.9; 340/855.4

(58) Field of Search ..... 367/81, 82, 83; 340/853.1, 854.4, 855.4, 856.4

(56) References Cited

U.S. PATENT DOCUMENTS

| | | | | |
|---|---|---|---|---|
| 2,810,546 | | 10/1957 | Eaton et al. | 255/1 |
| 3,588,804 | | 6/1971 | Fort | 340/18 |
| 3,790,930 | | 2/1974 | Lamel et al. | 340/18 |
| 3,813,656 | | 5/1974 | Fowler | 340/18 |
| 4,282,588 | | 8/1981 | Chanson et al. | 367/82 |
| 4,283,779 | | 8/1981 | Lamel | 367/82 |
| 4,302,826 | | 11/1981 | Kent et al. | 367/82 |
| 4,314,365 | | 2/1982 | Petersen et al. | 367/82 |
| 4,590,593 | * | 5/1986 | Rodney | 367/83 |
| 5,365,229 | * | 11/1994 | Gardner et al. | 340/855.4 |
| 5,387,907 | * | 2/1995 | Gardner et al. | 340/855.4 |
| 5,473,321 | * | 12/1995 | Goodman et al. | 340/855.4 |
| 5,490,121 | * | 2/1996 | Gardner et al. | 367/83 |
| 5,504,479 | * | 4/1996 | Doyle et al. | 340/854.9 |
| 5,850,369 | * | 12/1998 | Rorden et al. | 340/854.4 |
| 5,969,638 | * | 10/1999 | Chin | 367/83 |

OTHER PUBLICATIONS

Digital Communications, Second Edition, John G. Proakis, McGraw–Hill Book Company, New York© 1989, Chapter 6 (pp. 519–692).

* cited by examiner

*Primary Examiner*—Timothy Edward, Jr.
(74) *Attorney, Agent, or Firm*—Conley, Rose & Tayon, P.C.

(57) ABSTRACT

A reliable, high data rate, downhole acoustic telemetry system is disclosed. In one embodiment, the acoustic telemetry system includes a tubing string with an acoustic transmitter and an acoustic receiver mounted on it. The acoustic transmitter transmits telemetry information by modulating an acoustic carrier frequency that propagates along the walls of the tubing string. The transmitter is preferably mounted at a selected position relative to the end of the tubing string. The selected position is preferably less than $\lambda/4$ from the end or approximately $n\lambda/2$ from the end, where $\lambda$ is the wavelength of the carrier frequency in the tubing string, and n is a positive integer. In a more preferred embodiment, n may be the lesser of 4 times the number of cycles in the modulating toneburst and 40. The receiver is preferably mounted at approximately $(2n-1)\lambda/4$ relative to the end of the tubing string, where n is a positive integer. Such positioning prevents reflections of the acoustic signal from significantly degrading the received signal. The acoustic signaling advantageously employs pulse shaping to further improve system performance. To enhance data transmission rates, the acoustic receiver advantageously includes an equalizer that compensates for signal dispersion and intersymbol interference while simultaneously minimizing other forms of signal corruption such as additive noise and channel nonlinearities. The equalizer is preferably an adaptive, nonlinear equalizer that may also be fractionally spaced. Such equalizers eliminate any requirements for spacing intervals which allow signal reflections to die out. The resulting system is capable of higher data rates. When error correction codes are employed, no reliability losses are incurred.

22 Claims, 9 Drawing Sheets

HIGH DATA RATE ACOUSTIC TELEMETRY SYSTEM

BACKGROUND OF THE INVENTION

1. Field of the Invention

The present invention relates to a telemetry system for transmitting data from a downhole drilling assembly to the surface of a well. More particularly, the present invention relates to a system and method for improved acoustic signaling through a drill string.

2. Description of the Related Art

Modern petroleum drilling and production operations demand a great quantity of information relating to parameters and conditions downhole. Such information typically includes characteristics of the earth formations traversed by the wellbore, along with data relating to the size and configuration of the borehole itself. The collection of information relating to conditions downhole, which commonly is referred to as "logging", can be performed by several methods.

In conventional oil well wireline logging, a probe or "sonde" housing formation sensors is lowered into the borehole after some or all of the well has been drilled, and is used to determine certain characteristics of the formations traversed by the borehole. The tipper end of the sonde is attached to a conductive wireline that suspends the sonde in the borehole. Power is transmitted to the sensors and instrumentation in the sonde through the conductive wireline. Similarly, the instrumentation in the sonde communicates information to the surface by electrical signals transmitted through the wireline.

The problem with obtaining downhole measurements via wireline is that the drilling assembly must be removed or "tripped" from the drilled borehole before the desired borehole information can be obtained. This can be both time-consuming and extremely costly, especially in situations where a substantial portion of the well has been drilled. In this situation, thousands of feet of tubing may need to be removed and stacked on the platform (if offshore). Typically, drilling rigs are rented by the day at a substantial cost. Consequently, the cost of drilling a well is directly proportional to the time required to complete the drilling process. Removing thousands of feet of tubing to insert a wireline logging tool can be an expensive proposition.

As a result, there has been an increased emphasis on the collection of data during the drilling process. Collecting and processing data during the drilling process eliminates the necessity of removing or tripping the drilling assembly to insert a wireline logging tool. It consequently allows the driller to make accurate modifications or corrections as needed to optimize performance while minimizing down time. Designs for measuring conditions downhole including the movement and location of the drilling assembly contemporaneously with the drilling of the well have come to be known as "measurement-while-drilling" techniques, or "MWD". Similar techniques, concentrating more on the measurement of formation parameters, commonly have been referred to as "logging while drilling" techniques, or "LWD". While distinctions between MWD and LWD may exist, the terms MWD and LWD often are used interchangeably. For the purposes of this disclosure, the term MWD will be used with the understanding that this term encompasses both the collection of formation parameters and the collection of information relating to the movement and position of the drilling assembly.

When oil wells or other boreholes are being drilled, it is frequently necessary or desirable to determine the direction and inclination of the drill bit and downhole motor so that the assembly can be steered in the correct direction. Additionally, information may be required concerning the nature of the strata being drilled, such as the formation's resistivity, porosity, density and its measure of gamma radiation. It is also frequently desirable to know other downhole parameters, such as the temperature and the pressure at the base of the borehole, for example. Once this data is gathered at the bottom of the borehole, it is necessary to communicate it to the surface for use and analysis by the driller.

Sensors or transducers typically are located at the lower end of the drill string in LWD systems. While drilling is in progress these sensors continuously or intermittently monitor predetermined drilling parameters and formation data and transmit the information to a surface detector by some form of telemetry. Typically, the downhole sensors employed in MWD applications arc positioned in a cylindrical drill collar that is positioned close to the drill bit. The MWD system then employs a system of telemetry in which the data acquired by the sensors is transmitted to a receiver located on the surface. There are a number of telemetry systems in the prior art which seek to transmit information regarding downhole parameters up to the surface without requiring the use of a wireline tool. Of these, the mud pulse system is one of the most widely used telemetry systems for MWD applications.

The mud pulse system of telemetry creates "acoustic" pressure signals in the drilling fluid that is circulated under pressure through the drill string during drilling operations. The information that is acquired by the downhole sensors is transmitted by suitably timing the formation of pressure pulses in the mud stream. The information is received and decoded by a pressure transducer and computer at the surface.

In a mud pressure pulse system, the drilling mud pressure in the drill string is modulated by means of a valve and control mechanism, generally termed a pulser or mud pulser. The pulser is usually mounted in a specially adapted drill collar positioned above the drill bit. The generated pressure pulse travels up the mud column inside the drill string at the velocity of sound in the mud. Depending on the type of drilling fluid used, the velocity may vary between approximately 3000 and 5000 feet per second. The rate of transmission of data, however, is relatively slow due to pulse spreading, distortion, attenuation, modulation rate limitations, and other disruptive forces, such as the ambient noise in the drill string. A typical pulse rate is on the order of a pulse per second (1 Hz).

Given the recent developments in sensing and steering technologies available to the driller, the amount of data that can be conveyed to the surface in a timely manner at 1 bit per second is sorely inadequate. As one method for increasing the rate of transmission of data, it has been proposed to transmit the data using vibrations in the tubing wall rather than depending on pressure pulses in the drilling fluid. However, early systems have proven to be unreliable at data rates greater than about 3 bits/s due to acoustic reflections at tool joints and variations in the geometry of the tubing and borehole.

SUMMARY OF THE INVENTION

Accordingly, there is disclosed herein a reliable, high data rate, downhole acoustic telemetry system. In one embodiment, the acoustic telemetry system includes a tubing string with an acoustic transmitter and an acoustic receiver mounted on it. The acoustic transmitter transmits telemetry information by modulating an acoustic carrier frequency that propagates along the walls of the tubing string. The transmitter is preferably mounted at a selected position relative to the end of the tubing string. The selected position is preferably less than $\lambda/4$ from the end or approximately $n\lambda/2$ from the end, where $\lambda$ is the wavelength of the carrier frequency in the tubing string, and n is a positive integer. In a more preferred embodiment, n may be the lesser of 4 times the number of cycles in the modulating toneburst and 40. The receiver is preferably mounted at approximately $(2n-1)\lambda/4$ relative to the end of the tubing string, where n is a positive integer. Such positioning prevents reflections of the acoustic signal from significantly degrading the received signal. The acoustic signaling advantageously employs pulse shaping to further improve system performance.

To enhance data transmission rates, the acoustic receiver advantageously includes an equalizer that compensates for signal dispersion and intersymbol interference while simultaneously minimizing other forms of signal corruption such as additive noise and channel nonlinearities. The equalizer is preferably an adaptive, nonlinear equalizer that may also be fractionally spaced. Such equalizers eliminate any requirements for spacing intervals which allow signal reflections to die out. The resulting system is capable of higher data rates. When error correction codes are employed, no reliability losses are incurred.

BRIEF DESCRIPTION OF THE DRAWINGS

A better understanding of the present invention can be obtained when the following detailed description of the preferred embodiment is considered in conjunction with the following drawings, in which.

Figure 1:
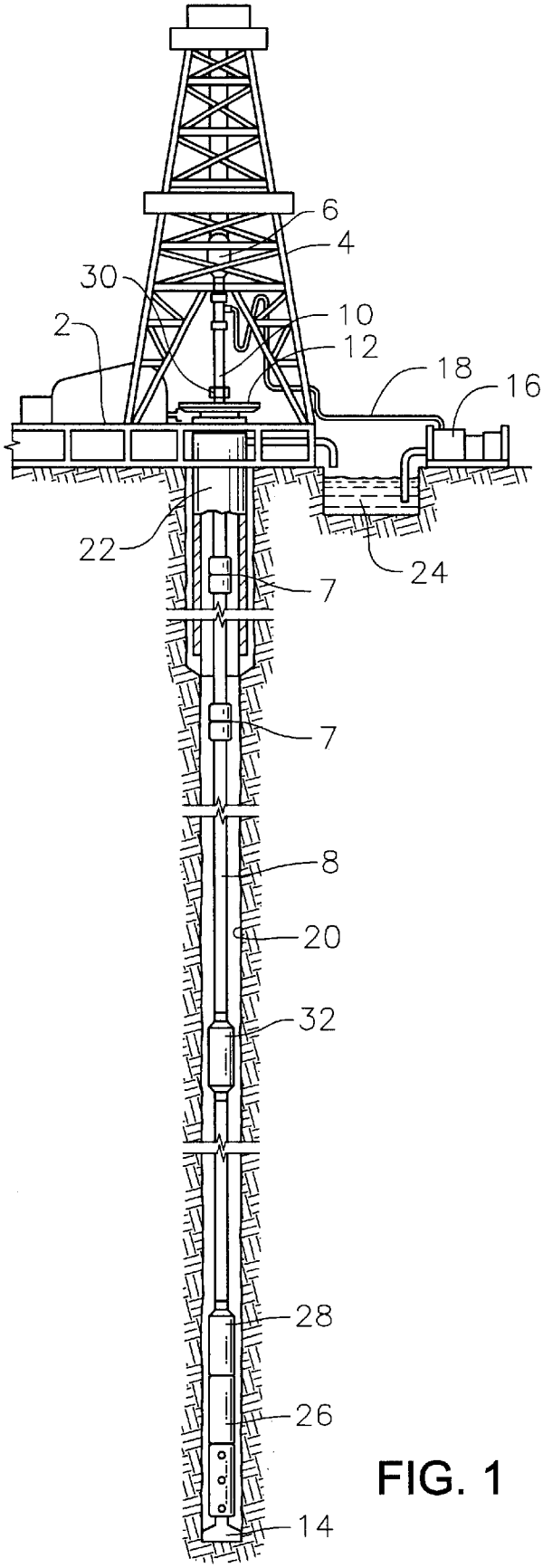
FIG. 1 is a schematic view of an oil well in which an acoustic telemetry system may be employed.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENT

Turning now to the figures, FIG. 1 shows a well during drilling operations. A drilling platform 2 is equipped with a derrick 4 that supports a hoist 6. Drilling of oil and gas wells is carried out by a string of drill pipes connected together by "tool" joints 7 so as to form a drill string 8. The hoist 6 suspends a kelly 10 that is used to lower the drill string 8 through rotary table 12. Connected to the lower end of the drill string 8 is a drill bit 14. The bit 14 is rotated and drilling accomplished by rotating the drill string 8, by use of a downhole motor near the drill bit, or by both methods. Drilling fluid, termed mud, is pumped by mud recirculation equipment 16 through supply pipe 18, through drilling kelly 10, and down through the drill string 8 at high pressures and volumes (such as 3000 p.s.i. at flow rates of up to 1400 gallons per minute) to emerge through nozzles or jets in the drill bit 14. The mud then travels back up the hole via the annulus formed between the exterior of the drill string 8 and the borehole wall 20, through the blowout preventer 22, and into a mud pit 24 on the surface. On the surface, the drilling mud is cleaned and then recirculated by recirculation equipment 16. The drilling mud is used to cool the drill bit 14, to carry cuttings from the base of the bore to the surface, and to balance the hydrostatic pressure in the rock formations.

In a preferred embodiment, downhole sensors 26 are coupled to an acoustic telemetry transmitter 28 that transmits telemetry signals in the form of acoustic vibrations in the tubing wall of drill string 8. An acoustic telemetry receiver 30 is coupled to the kelly 10 to receive transmitted telemetry signals. One or more repeater modules 32 may be provided along the drill string to receive and retransmit the telemetry signals. The repeater modules 32 include both an acoustic telemetry receiver and an acoustic telemetry transmitter configured similarly to receiver 30 and the transmitter 28.

Figure 2:
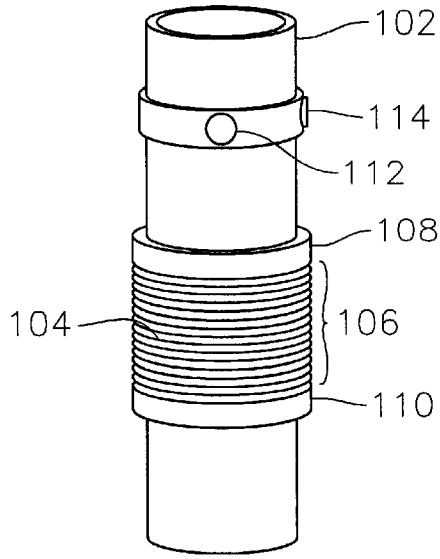
FIG. 2 is a view of an acoustic transmitter and an acoustic receiver.

For the purposes of illustration, FIG. 2 shows a repeater module 32 that includes an acoustic transmitter 104 and an acoustic sensor 112 mounted on a piece of tubing 102. One skilled in the art will understand that acoustic sensor 112 is configured to receive signals from a distant acoustic transmitter, and that acoustic transmitter 104 is configured to transmit to a distant acoustic sensor. Consequently, although the transmitter 104 and sensor 112 are shown in close proximity, they would only be so proximate in a repeater module 32 or in a bidirectional communications system. Thus, for example, transmitter 28 might only include the transmitter 104, while receiver 30 might only include sensor 112, if so desired.

The following discussion centers on acoustic signaling from a transmitter 28 near the drill bit 14 to a sensor located some distance away along the drill string. Various acoustic transmitters are known in the art, as evidenced by U.S. Pat. Nos. 2,810,546, 3,588,804, 3,790,930, 3,813,656, 4,282,588, 4,283,779, 4,302,826, and 4,314,365, which are hereby incorporated by reference. The transmitter 104 shown in FIG. 2 has a stack of piezoelectric washers 106 sandwiched between two metal flanges 108, 110. When the stack of piezoelectric washers 106 is driven electrically, the stack 106 expands and contracts to produce axial compression waves in tubing 102 that propagate axially along the drill string. Other transmitter configurations may be used to produce torsional waves, radial compression waves, or even transverse waves that propagate along the drill string.

Various acoustic sensors are known in the art including pressure, velocity, and acceleration sensors. Sensor 112 preferably comprises a two-axis accelerometer that senses accelerations along the axial and circumferential directions. One skilled in the art will readily recognize that other sensor configurations are also possible. For example, sensor 112 may comprise a three-axis accelerometer that also detects acceleration in the radial direction. A second sensor 114 may be provided 90 or 180 degrees away from the first sensor 112. This second sensor 114 also preferably comprises a two or three axis accelerometer. Additional sensors may also be employed as needed.

A reason for employing multiple sensors stems from an improved ability to isolate and detect a single acoustic wave propagation mode to the exclusion of other propagation modes. Thus, for example, a multi-sensor configuration may exhibit improved detection of axial compression waves to the exclusion of torsional waves, and conversely, may exhibit improved detection of torsional waves to the exclusion of axial compression waves. Copending application Ser. No. 09/332,641 filed Jun. 14, 1999 and entitled "Acoustic Telemetry System With Drilling Noise Cancellation" by inventors W. R. Gardner, V. V. Shah, and J. W. Minear discusses one desirable sensor configuration, and is hereby incorporated herein by reference.

Figure 3:
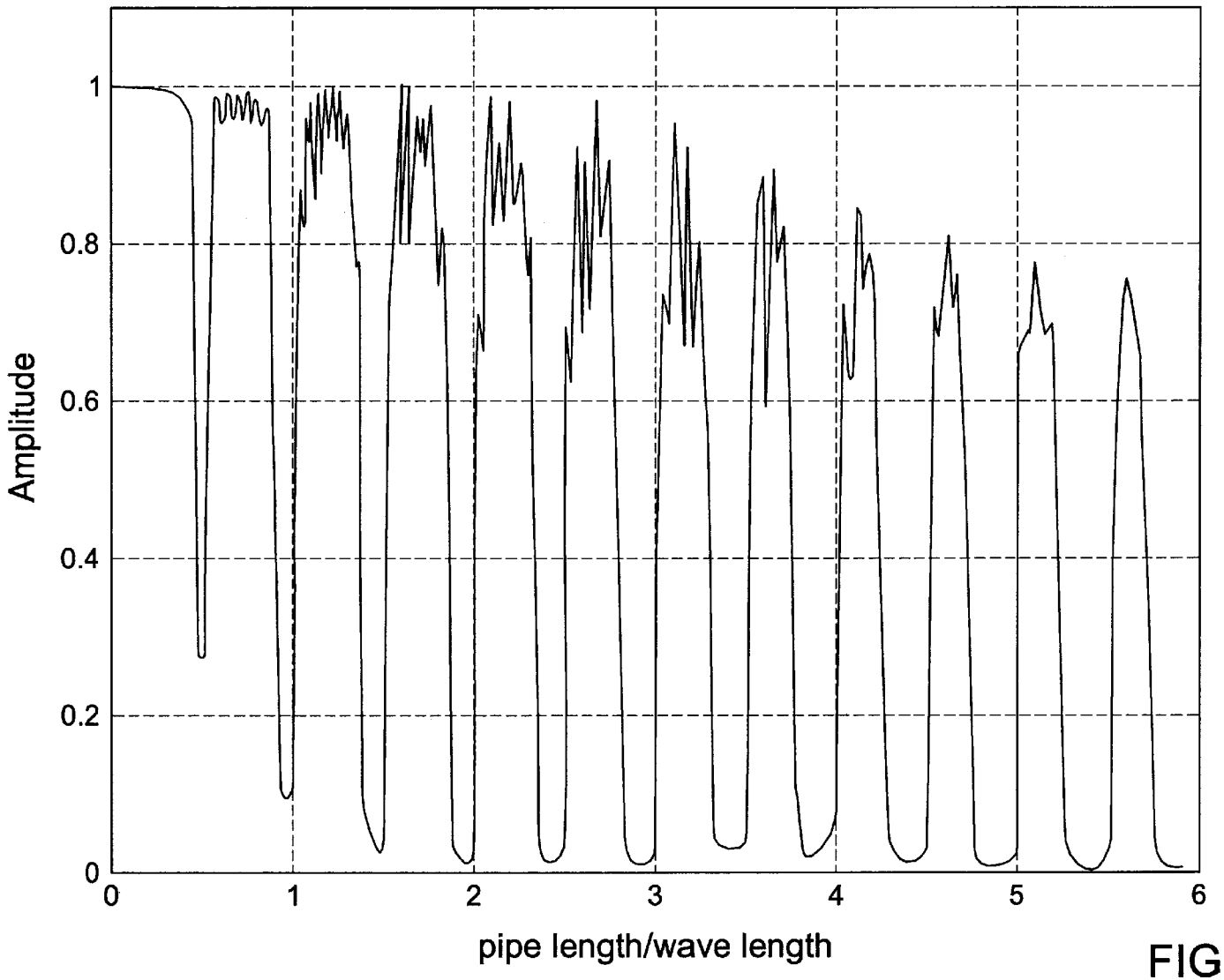
FIG. 3 is a graph of an exemplary communications channel spectrum provided by acoustic transmission through a drill string.

The inventors have found that the design of the transmitting and receiving portions of a high-rate acoustic telemetry system benefits when various factors are taken into account. Several of these factors are discussed with reference to FIGS. 3–8. The drill string 8 has a characteristic frequency spectrum for acoustic signaling resembling the spectrum shown in FIG. 3. The frequency f of an acoustic signal is related to its wavelength $\lambda$ by the equation $c=f\lambda$, where c is the speed of sound in the drill string (approximately 5100 m/s). Low frequencies (long wavelengths) are shown on the left side of FIG. 3, while high frequencies (short wavelengths) are shown on the right. Those frequencies having wavelengths around 2L/n, where L is the length of an individual drill pipe and n is any integer greater than zero, are blocked by the drill string, while those frequencies having wavelengths near $4\ L/(2n-1)$ are passed by the drill string, albeit with greater attenuation at higher frequencies. Thus, for a string of 12m drill pipe, frequencies around 100 Hz ($\lambda$=48 m), 300 Hz ($\lambda$=16 m), 500 Hz ($\lambda$=9.6 m), 700 Hz ($\lambda$=6.9 m), . . . , would be good carrier frequencies for acoustic signals.

If transmitter 28 transmits a short (30 ms) sinusoidal pulse, the signal received by receiver 30 depends on the position of the transmitter 28. The acoustic signal from the transmitter reflects strongly off of acoustic reflectors such as the end of the tubing, thereby producing a "ghost" signal which can interfere with the originally transmitted signal. For positions less than $\lambda/4$ away from the end of the tubing, the reflection beneficially contributes to the signal energy, and at positions $n\lambda/2$ from the end of the tubing, the reflection interferes constructively with the original signal. However, at positions $(2n-1)\lambda/4$ from the end of the tubing, the reflection interferes destructively with the original signal. Nevertheless, at positions greater than about 125 meters away, the reflection experiences a time delay great enough to be distinct from the original signal pulse for short signal pulses, and for positions greater than about 250 meters away, the reflection is attenuated to less than half the original signal amplitude. These latter two conditions can be compensated for in the receiver, so that for sufficiently large values of n, the exact position relative to the end of the tubing becomes unimportant.

Figure 4:
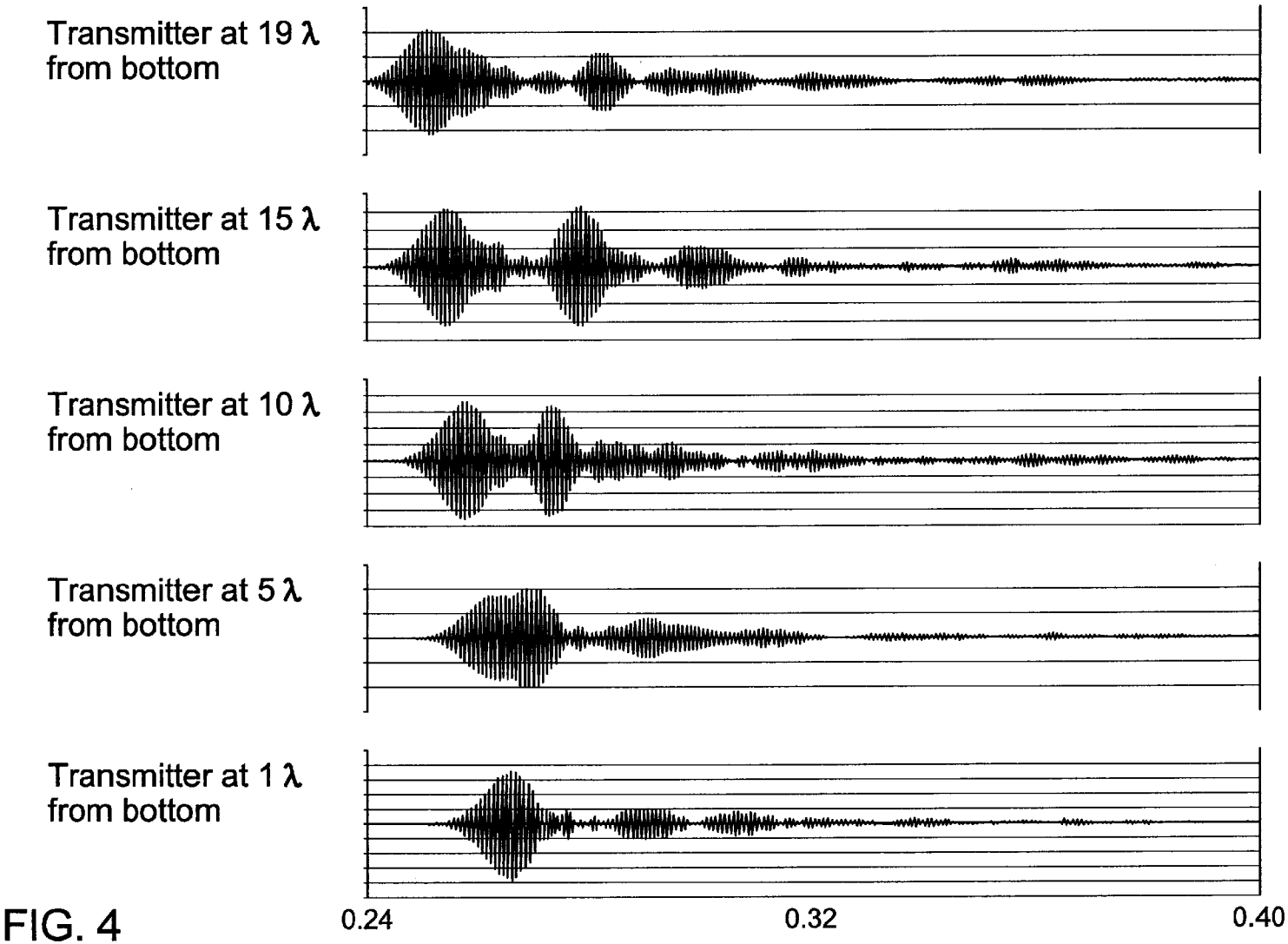
FIG. 4 is a graph of exemplary channel responses to a tone burst that demonstrate the impact of transmitter location.

FIG. 4 shows the received signal for various transmitter positions relative to the drill bit (which is modeled as a free end of the tubing). The transmitter positions, from top to bottom in FIG. 4, are $\lambda$, $5\lambda$, $10\lambda$, $15\lambda$, and $19\lambda$. In the first two graphs, the reflection is combined with the original signal, and in the remaining graphs, the reflection appears as an increasingly delayed, distinct signal pulse.

Accordingly, the preferred transmitter placement is either less than $\lambda/4$ away from the end of the tubing, greater than 125 meters from the nearest strong reflector (such as the lower end of the drill string), or approximately $n\lambda/2$ from any strong reflectors within 125 meters. Here, approximately is defined to be within $\lambda/8$ of the specified position. Alternatively, it is contemplated that a transmitter location at or beyond the lesser of $2n\lambda$ and $20\lambda$, where n is the number of cycles in the modulating toneburst, or at approximately $\lambda$ may be preferred. This alternative preference may be specified when it is desired to minimize equalization efforts.

Figure 5:
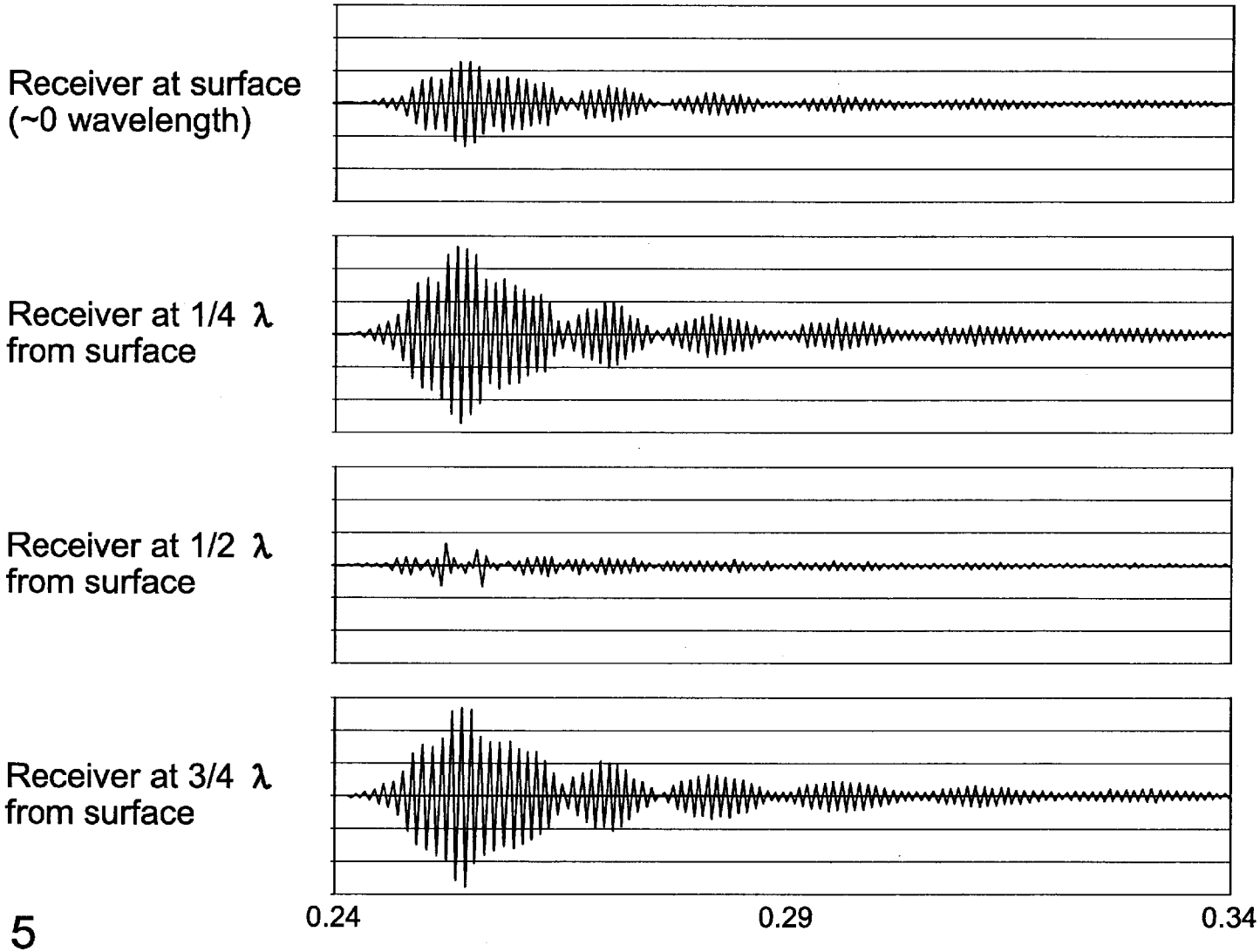
FIG. 5 is a graph of exemplary channel responses to a tone burst that demonstrate the impact of receiver location.

As shown in FIG. 5, the received signal similarly depends on the position of the receiver 30 relative to any nearby reflectors (such as the upper end of the drill string). However, the upper end of the drill string is more closely modeled as a fixed end rather than a free end, due to the mass of the blocks suspending the drill string (if the slips are not in place) or the mass of the drilling platform (if the slips are in place). When the upper end of the tubing is suspended from the rotary table by the slips, the slips act as a "fixed" end for the tubing. The top graph in FIG. 5 shows the received signal when the receiver 30 is located near the end of the drill string. The second graph shows the received signal when the receiver 30 is located $\lambda/4$ away from the end of the drill string, the third graph shows the received signal when the receiver is located $\lambda/2$ away, and the bottom graph shows the received signal when the receiver 30 is located $3\lambda/2$ from the end of the drill string. The third graph shows the effects of destructive interference on the received signal. Consequently, the preferred receiver location is near the end of the drill string or at approximately $(2n-1)\lambda/4$ below the end of the tubing to minimize destructive interference by the signal reflections. It is noted that this positioning is relative to the "effective" end of the tubing rather than the actual end of the tubing. When the drill string is suspended from the slips, the slips act as the effective end of the tubing.

Figure 6:
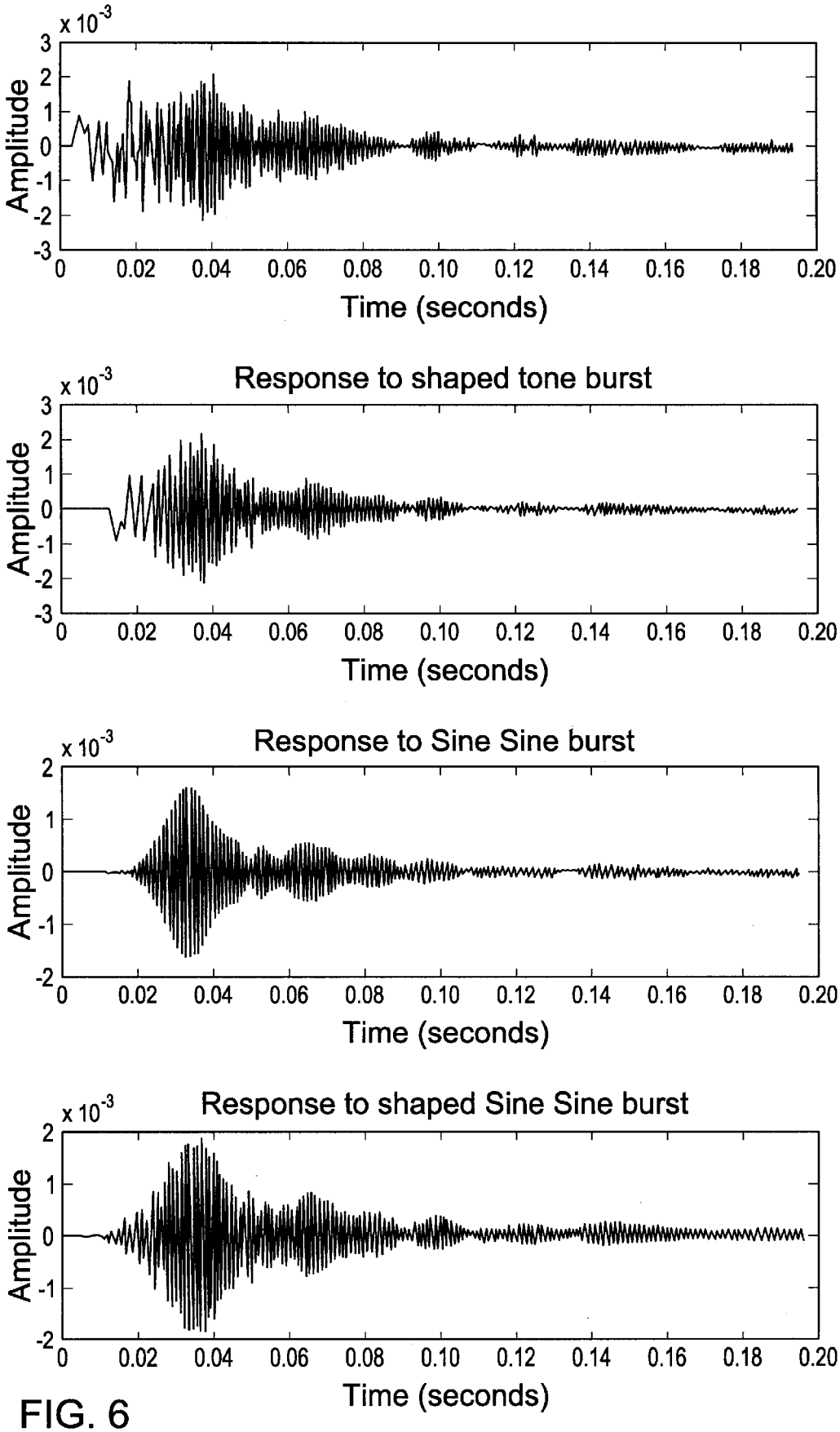
FIG. 6 is a graph of exemplary channel responses to variously shaped input pulses.
Figure 7:
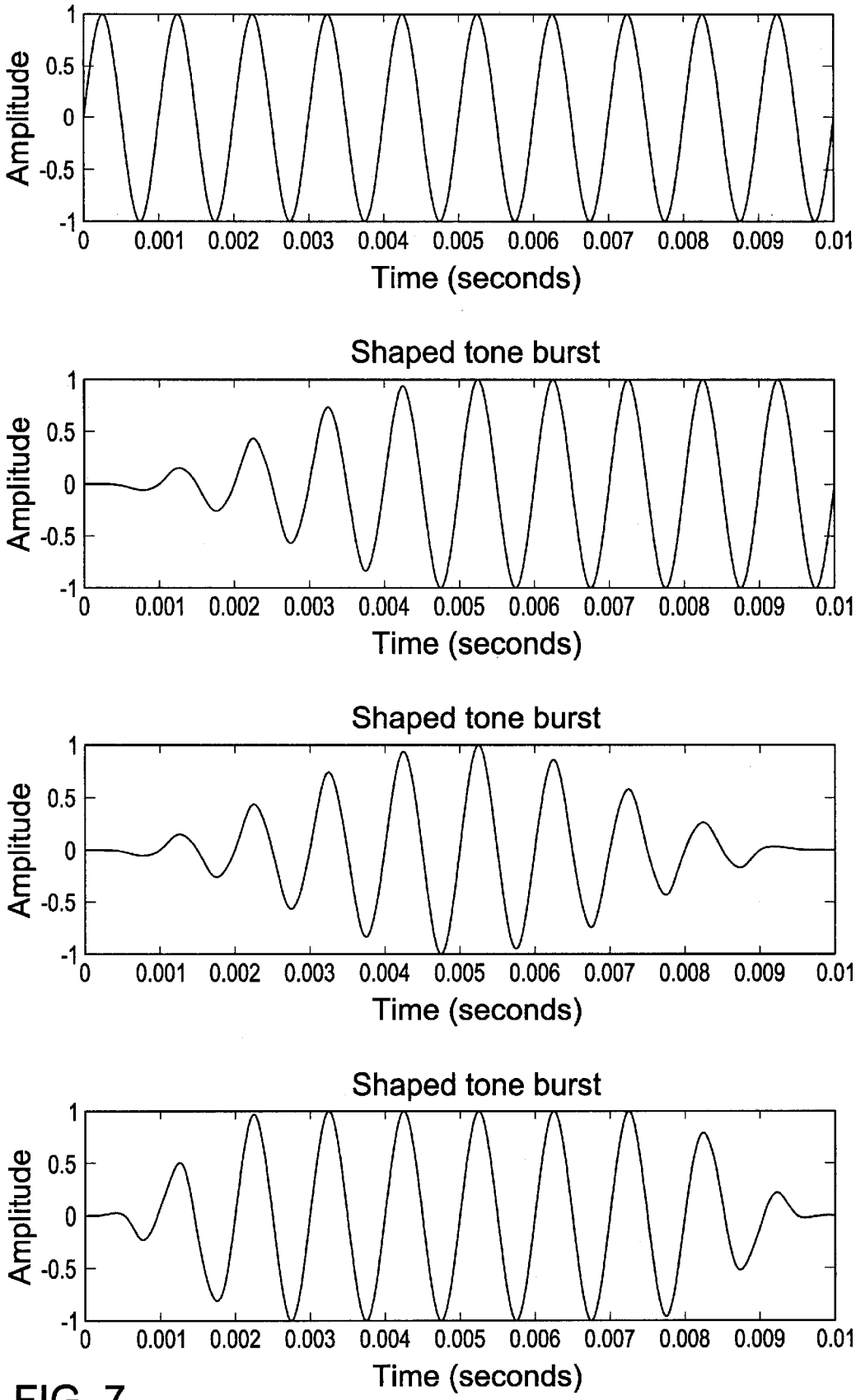
FIG. 7 is a graph of the input responses used to generate the channel responses of FIG. 6.

FIG. 6 shows how the received signal varies when the transmitted pulse assumes the corresponding shapes shown in FIG. 7. The transmitted pulse shapes are, in order from top to bottom: rectangular, linear attack, raised cosine, and exponential attack and decay. The transmitted pulses are zero outside the interval shown in FIG. 7. The sudden transitions from zero to a full amplitude sine wave (or vice versa) in the rectangular pulse and linear attack waveforms introduce some high frequency components that appear as noisy "spikes" in the upper two graphs in FIG. 6. Of the remaining two, the raised cosine pulse (which has an amplitude of $[1-\cos(2\pi ft/n)]/2$) offers the smoothest, well-behaved signal at the receiver. This is because the pulse energy is concentrated into a narrower frequency band, which results in less dispersion of the signal energy at the receiver.

Figure 8:
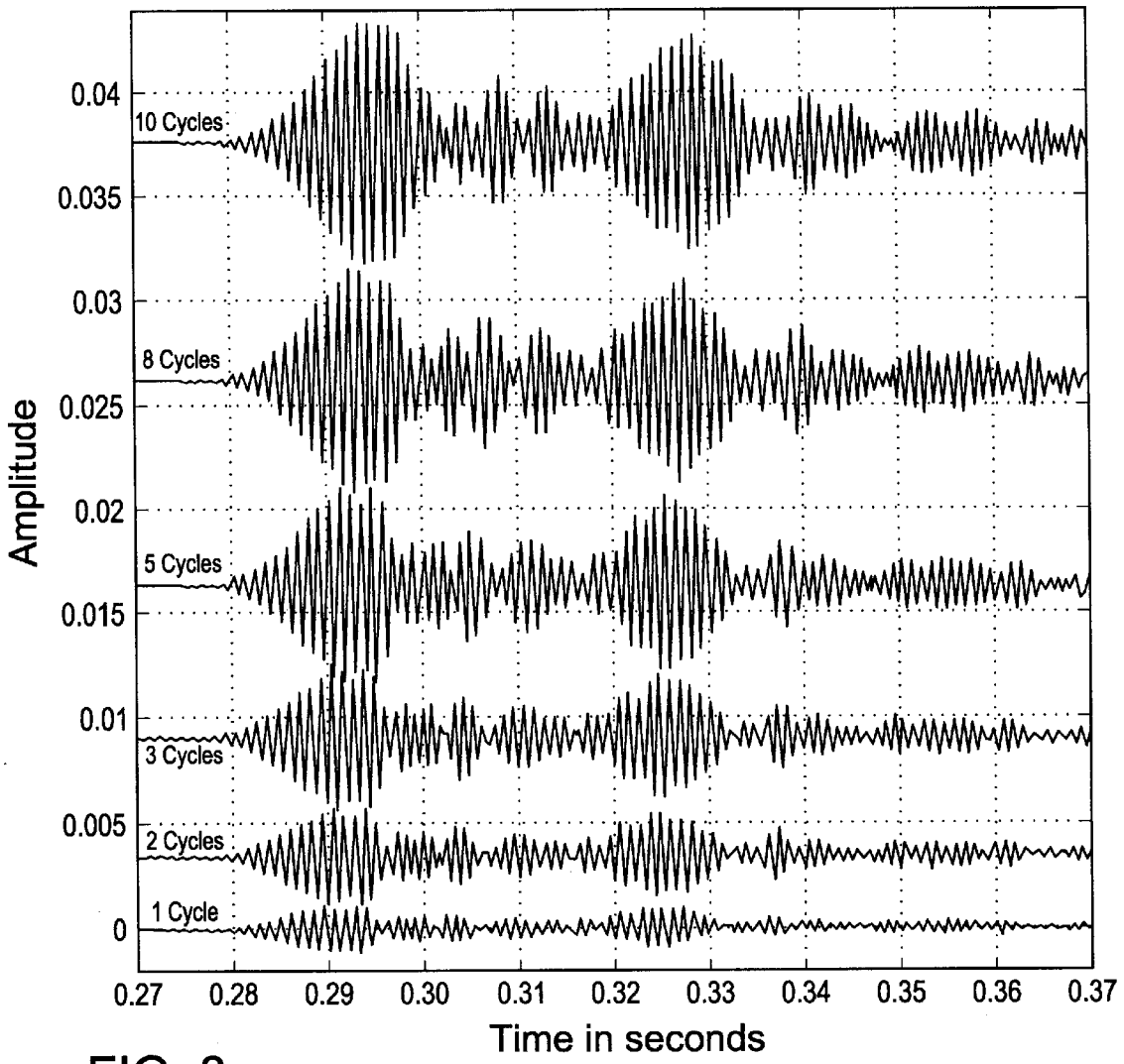
FIG. 8 is a graph of exemplary channel responses to tone bursts of varying lengths.

In the raised cosine pulse equation, n is the number of cycles in the transmitted pulse. As shown in FIG. 8, increasing the number of cycles in the transmitted pulse increases the length of the received signal, but more importantly, significantly increases the amplitude of the received signal. A good tradeoff is achieved with approximately 8–10 cycles.

Figure 9:
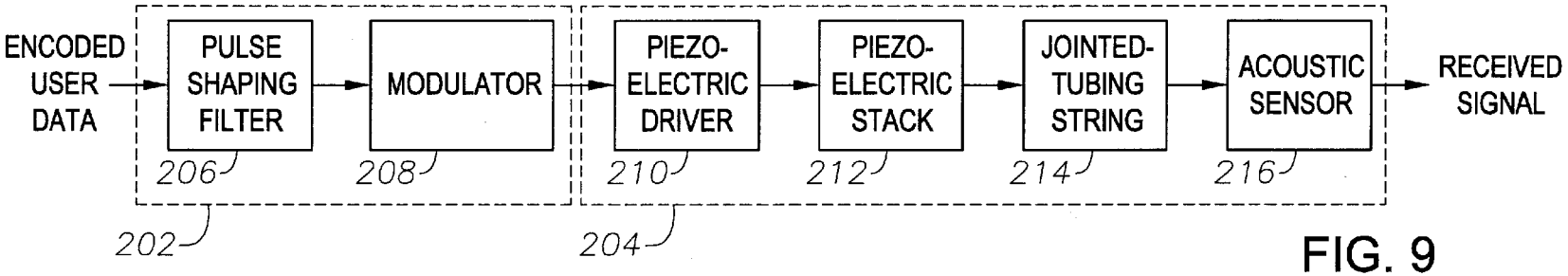
FIG. 9 is a functional block diagram of a first portion of an acoustic telemetry system.

FIG. 9 shows a functional block diagram of a transmitter 202 and communications channel 204. The transmitter 202 receives a binary data stream which preferably has error correction code (ECC) protection. The binary data stream is preferably an analog signal or oversampled digital sequence that, when passed through pulse shaping filter 206, yields a raised-cosine pulse sequence with raise-cosine pulses representing ones and the absence of such pulses representing zeros. Modulator 208 multiplies the raised cosine pulses with a carrier frequency signal to produce a modulated signal.

A piezoelectric driver 210, piezoclectric stack 212, jointed tubing string 214, and an acoustic sensor 216 act together to form communications channel 204. The piezoelectric driver 210 drives the piezoelectric stack 212 to generate the modulated signal in the form of acoustic waves. The acoustic waves propagate along jointed tubing string 214 and are received by acoustic sensor 216. The acoustic sensor 216 converts the acoustic waves into a received signal.

Figure 10:
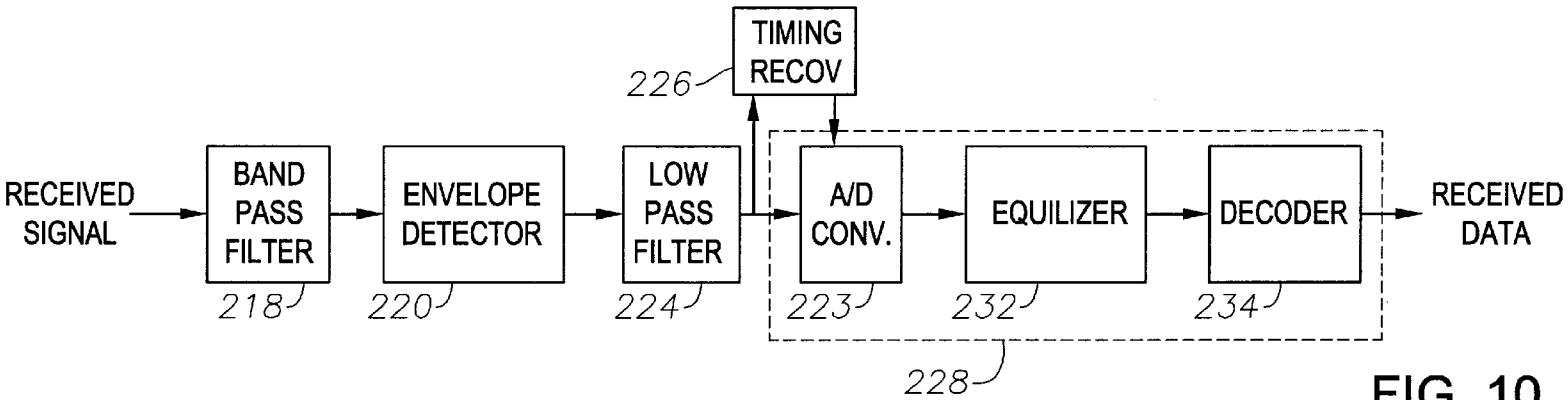
FIG. 10 is a functional block diagram of a second portion of an acoustic telemetry system.

A preferred embodiment of a receiver is shown in FIG. 10. The preferred embodiment includes a bandpass filter 218, an envelope detector 220, a low pass filter 224, a timing recovery module 226, and a digital module 228. Bandpass filter 218 filters the received signal to block energy outside the frequency band of the transmitted signal. Envelope detector 220 demodulates the filtered signal to determine an envelope signal. The envelope signal is an indicator of the amplitude of the filtered signal. This envelope detector preferably consists of a two-way rectifier, although a phase-lock loop demodulator may also be used. Low pass filter 224 blocks high frequency components of the envelope signal to provide a "smoothed" envelope signal. Timing recovery module 226 processes the smoothed envelope signal to determine a timing signal that indicates optimum sampling times. Digital module 228 samples the smoothed envelope signal at sampling times indicated by the timing signal, and operates on the sampled signal to determine the user data that it represents.

The digital module 228 includes an analog-to-digital converter (ADC) 230, an equalizer 232, and a decoder 234. ADC 230 samples the envelope signal. Equalizer 232 "equalizes" the sampled signal to compensate for the channel impulse response, thereby achieving a binary data stream indicative of the encoded user data. The binary data stream is decoded by decoder 234 to correct errors and obtain a received data stream that hopefully equals the transmitted user data. One example of a suitable decoder is a Reed-Solomon decoder.

Figure 11:
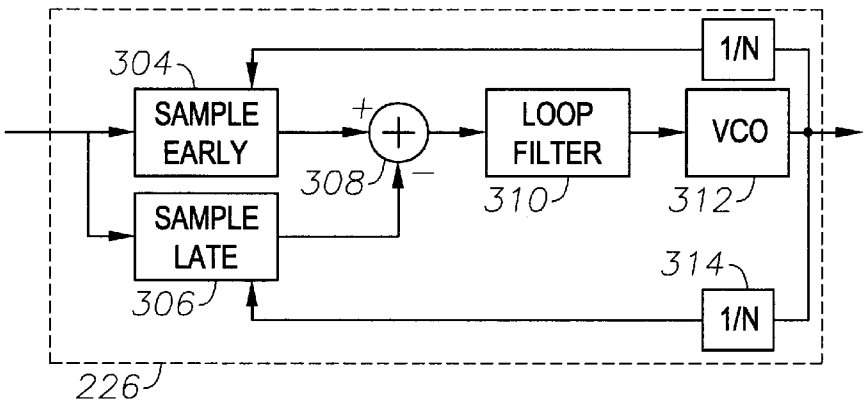
FIG. 11 is a functional block diagram of a timing recovery module.

FIG. 11 shows a preferred embodiment of timing recovery module 226 that includes: a sample early block 304, a sample late block 306, an adder 308, a loop filter 310, a voltage-controlled oscillator (VCO) 312, and an optional frequency divider block 314. Sample early block 304 and sample late block 306 both sample the smoothed envelope signal in response to a clock signal. The sample early block 304 samples a fixed time interval before the sample late block 306. The difference between the sampled values is determined by adder 308 and filtered by loop filter 310. The filtered difference is provided to VCO 312 which generates a clock signal with a frequency that is proportional to the input voltage. The clock signal may optionally be divided down in frequency by a frequency divider block 314 which generates one clock signal transition for every N input signal transitions. The frequency divider block is used when it is desired to have the digital module oversample the smoothed envelope signal. For clarity, two frequency divider blocks are shown in the figure, but their purpose may be served by a single frequency divider block.

The timing recovery block operates to minimize the difference between early and late sampled values. For symmetric signal pulses, this occurs when the optimal peak sampling time is centered between the early and late sampling times. The ADC 230, by delaying the clock signal by half the time interval between the early and late sampling times, is thus able to sample at the ideal sampling times. Other timing recovery modules are also known and contemplated. An alternate timing recovery module locates zero-crossings of a smoothed envelope derivative signal.

Many suitable equalizers 232 are known and contemplated, such as a linear equalizer, a fractionally-spaced equalizer, a decision feedback equalizer, a maximum likelihood sequence estimator, and a nonlinear equalizer. The latter is described with reference to FIG. 12. The others are described in detail in Chapter 6 (pp. 519–692) of John G. Proakis, *Second Edition Digital Communications*, McGraw-Hill Book Company, New York, (c)1989, which is hereby incorporated herein by reference. Each of the equalizers may be implemented in adaptive form to enhance their performance over a range of variable channel conditions. Filter adaptation is well known and is described in various standard texts such as Simon Haykin, *Adaptive Filter Theory*, Prentice-Hall, Englewood Cliffs, (c)1986.

The above equalizers operate to reverse or control distortions incurred by the transmitted signal as it passes through the communications channel. In particular, phase dispersion of the transmitted signal causes inter-symbol interference that the equalizers remove. Other equalizers that merely operate to minimize noise, such as an "integrate-and-dump" detector, are known and may be used in place of equalizer 232. These may be preferred when digital filtering is determined to be unavailable or undesirable.

Figure 12:
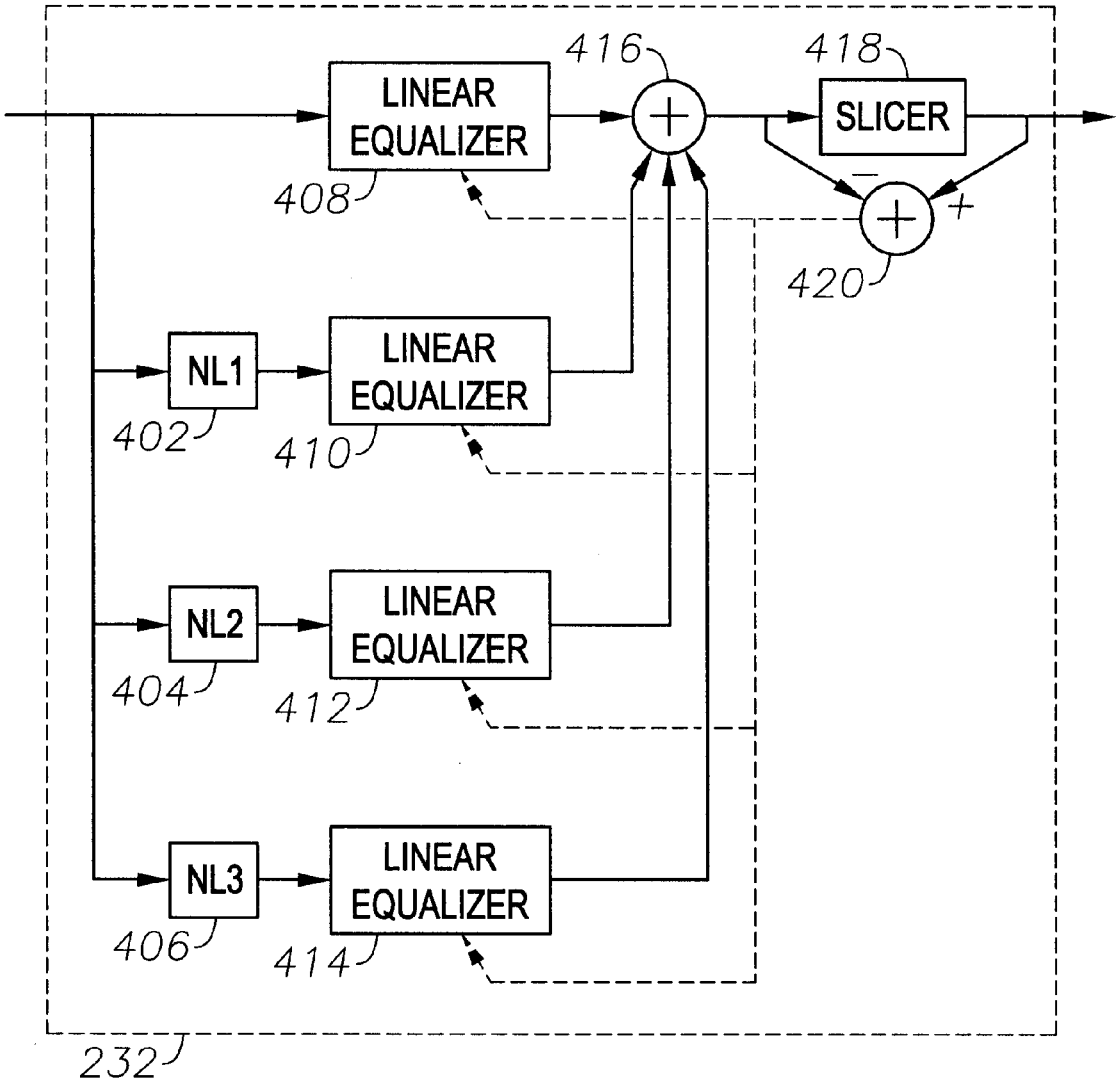
FIG. 12 is a functional block diagram of an equalizer module.

FIG. 12 shows one implementation of a nonlinear equalizer 232. The implementation shown has three nonlinear elements 402, 404, 406. The operations of the nonlinear elements are typically powers. For example, element 402 may be chosen to implement a squaring operation on the input signal, while element 404 may be chosen to implement a cubing operation on the input signal. Inversion, fractional powers, logarithms, and exponentials may also be used. One contemplated operation for element 406 is the subtraction of a constant. A set of linear equalizers 408, 410, 412, 414, respectively filter the input signal and the outputs of the nonlinear elements 402, 404, 406. The filtered signals are summed together at adder 416 to form an equalized signal. A decision element, or "slicer", 418 converts the equalized signal into digital symbols (e.g. bits) for decoder 234. In an adaptive embodiment, an adder 420 determines the difference between the equalized signal and the output of the decision element 418. This difference is used as an error signal for adaptation of the linear equalizers. The nonlinear equalizer is preferred when the channel or the demodulation process introduce nonlinearities into the received signal.

The initial transversal filter in a decision feedback equalizer can be implemented in a fractionally-spaced, nonlinear form, to make a non-linear, fractionally-spaced decision feedback equalizer (NL-FS-DFE). This is a preferred equalizer for the disclosed acoustic receiver. It is contemplated to implement the feedback filter of the decision feedback equalizer as a nonlinear and/or fractionally-spaced filter, but this is presently believed unnecessary to achieve adequate performance.

It is noted that the disclosed system offers reliable data transmission rates one or two orders of magnitude greater than existing acoustic telemetry systems. This is achieved through pulse shaping, careful transmitter and receiver placement, and advanced receiver design. In addition, multiple carriers may be used to frequency-multiplex the telemetry signals.

It is further noted that acoustic signaling may be performed in both directions, uphole and downhole. Repeaters may also be included along the drill string to extend the signaling range. In the preferred embodiment no more than one acoustic transmitter will be operating at any given time. The disclosed noise cancellation strategy is expected to be most advantageous for acoustic receivers located near the drill bit, as well as for acoustic receivers "listening" to a transmitter located near the drill bit. However, improved system performance is expected from the use of noise cancellation by all the receivers in the system. It is further noted that the disclosed acoustic telemetry system may operate through continuous (coiled) tubing as well as threaded tubing, and can be employed for drilling, production enhancement, completion/long term applications, and zonal isolation. Examples of drilling applications include MWD/LWD telemetry for underbalanced drilling, air drilling, speed drilling, and multisensor data; seismic while drilling (SWD) telemetry for clock synchronization, look ahead vertical seismic profiling (VSP), and bit wear monitoring; smart drilling tools telemetry for adjusting stabilizers and directing rotary-steerable tools, telemetry for pressure and temperature testing of the formation; logging while tripping telemetry for depth correlation logging; and short hop communication for datalink between telemetry module and drill bit sensors. Examples of production enhancement applications include monitoring temperature, pressure, velocity, phase, etc. information during hydraulic fracturing; and two-way telemetry and control system for acidizing. Examples of completion/long term applications include drill stem testing; co-locating, triggering, and monitoring tubing-conveyed perforation (TCP); controlling vent and smart valves; and communication from main bore to laterals in multilateral wells. Examples of zonal isolation applications include monitoring temperature and pressure for foam cementing; and plug release indicators for cementing. Other applications are also contemplated.

In drilling applications, the acoustic apparatus at the surface end of the tubing string may preferably be mounted on the kelly. In this manner, the apparatus may be located at an optimal location that remains fixed even as the tubing string lengthens.

Numerous variations and modifications will become apparent to those skilled in the art once the above disclosure is fully appreciated. It is intended that the following claims be interpreted to embrace all such variations and modifications.

What is claimed is:

1. A high-data rate acoustic telemetry system that comprises:

a tubing string having a first end and a second, fixed end opposite said first end;

an acoustic transmitter mounted on said tubing string at a selected position relative to said first end, wherein said acoustic transmitter is configured to generate an amplitude-modulated acoustic signal having a carrier frequency that propagates along the tubing string, wherein said selected position is selected from a set that consist of positions less than $\lambda/4$ away from said first end and positions approximately $n\lambda/2$ from said first end, where $\lambda$ is a wavelength associated with the carrier frequency and n is a positive integer; and an acoustic receiver mounted on said tubing string at a second selected position relative to said second end, wherein said second selected position is selected from a second set that consist of positions approximately $(2k-1)\lambda/4$ from said second end, wherein k is a positive integer, wherein the acoustic receiver includes:

an acoustic sensor configured to convert acoustic signals in said tubing string into a received signal;

a bandpass filter coupled to the acoustic sensor to receive the received signal, and configured to convert the received signal into a bandpass signal by blocking energy outside a desired frequency range;

a demodulator coupled to the bandpass filter to receive the bandpass signal, and configured to convert the bandpass signal into a baseband signal;

a detection module coupled to the demodulator to receive the baseband signal, and configured to convert the baseband signal into a detected symbol sequence, wherein the detection module includes:

an adaptive non-linear equalizer that operates on the baseband signal to minimize signal corruption and to render decisions that indicate a probable symbol sequence.

2. The system of claim 1, wherein the amplitude modulated acoustic signal represents binary 1's by shaped pulses, and represents binary 0's by an absence of said pulses.

3. The system of claim 1, wherein the demodulator includes:

a rectifier that converts the bandpass signal into a rectified signal; and a lowpass filter that converts the rectified signal into the baseband signal.

4. The system of claim 2, wherein said pulses have a shape expressed by $[1-\cos(2\pi ft/m)]/2$, $0 \leqq t < \tau$, when normalized, where f is the carrier frequency, $\tau$ is the pulse width, and m is a number of carrier frequency cycles in each pulse.

5. The system of claim 4, wherein m is an integer in an inclusive range between 4 and 14.

6. The system of claim 1, wherein the acoustic receiver further includes a timing recovery module configured to receive the baseband signal and configured to generate a timing signal that indicates optimum sampling times of the baseband signal.

7. The system of claim 6, wherein the timing module includes:

an early sampler configured to sample the baseband signal;

a late sampler configured to sample the baseband signal a fixed time after the early sampler;

a difference element configured to determine a difference between baseband signal values sampled by the early and late samplers;

a filter configured to convert the difference into a voltage signal that minimizes a mean square value of the difference; and a voltage controlled oscillator configured to convert the voltage signal into the timing signal.

8. A method for communicating between a downhole tool and a surface installation, wherein the method comprises:

encoding user data to produce a binary stream of encoded data;

generating a baseband signal of shaped pulses that represents the binary stream of encoded data;

multiplying the baseband signal by a carrier frequency signal to produce a modulated signal, wherein the carrier frequency signal has an associated wavelength $\lambda$;

transmitting the modulated signal as an acoustic signal from a position approximately $n\lambda/2$ from an end of a tubing string, wherein the acoustic signal propagates along the tubing string from that position, wherein n is a nonnegative integer;

receiving the acoustic signal at a second position approximately $(2k+1)\lambda/2$ from an end of the tubing string, wherein k is a nonnegative integer;

converting the acoustic signal into a received signal;

converting the received signal into a baseband signal;

filtering the baseband signal to minimize signal corruption, thereby producing an equalized signal;

converting the equalized signal into a binary stream of received data; and decoding the binary stream of received data to determine the user data.

9. The method of claim 8, wherein said converting the received signal into a baseband signal includes:

passing the received signal through a bandpass filter to block out-of-band energy;

rectifying the received signal to produce a rectified signal; and passing the rectified signal through a lowpass filter to obtain the baseband signal.

10. The method of claim 8, wherein said filtering the baseband signal includes:

passing the baseband signal through a transversal filter with adaptive coefficients; and adjusting the coefficients based on a difference between the equalized signal and the binary stream of received data, wherein said adjustment is designed to minimize a mean square value of said difference.

11. The method of claim 8, wherein the shaped pulses have a shape expressed by $[1-\cos(2\pi ft/m)]/2$, $0 \leqq t < \tau$, when normalized, where f is the carrier frequency, $\tau$ is a pulse width, and m is a number of carrier frequency cycles in each pulse.

12. The method of claim 11, wherein m is an integer in an inclusive range between 4 and 14.

13. A high-data rate acoustic telemetry system that comprises:

a tubing string;

an acoustic transmitter mounted on said tubing string at a selected position relative to an end of said tubing string, wherein said acoustic transmitter is configured to generate an acoustic signal having a carrier frequency that propagates along the tubing string, wherein said selected position is selected from a set that consist of positions less than $\lambda/4$ away from said first end and positions approximately $n\lambda/2$ from said first end, where $\lambda$ is a wavelength associated with the carrier frequency and n is a positive integer; and an acoustic receiver coupled to said tubing string to receive said acoustic signal, wherein the acoustic receiver includes:

an acoustic sensor configured to convert acoustic signals in said tubing string into a received signal;

a bandpass filter coupled to the acoustic sensor to receive the received signal, and configured to convert the received signal into a bandpass signal by blocking energy outside a desired frequency range;

a rectifier coupled to the bandpass filter to receive the bandpass signal, and configured to convert the bandpass signal into a rectified signal;

a lowpass filter coupled to the rectifier to receive the rectified signal and configured to convert the rectified signal into a baseband signal; and an equalizer configured to convert the baseband signal into a detected symbol sequence, wherein the equalizer is one of a set that includes a linear equalizer, a decision feedback equalizer, and a maximum likelihood sequence estimator.

14. The system of claim 13, wherein the acoustic receiver is mounted on the tubing string at a second selected position relative to said a fixed portion of the tubing, wherein said second selected position is selected from a second set that consist of positions approximately $(2k-1)\lambda/2$ from said fixed portion, wherein k is a positive.

15. The system of claim 13, wherein the equalizer is adaptive and fractionally spaced.

16. The system of claim 13, wherein the acoustic receiver further includes a timing recovery module configured to receive the baseband signal and configured to generate a timing signal that indicates optimum sampling times of the baseband signal.

17. The system of claim 16, wherein the timing module includes:

an early sampler configured to sample the baseband signal;

a late sampler configured to sample the baseband signal a fixed time after the early sampler;

a difference element configured to determine a difference between baseband signal values sampled by the early and late samplers;

a filter configured to convert the difference into a voltage signal that minimizes a mean square value of the difference; and a voltage controlled oscillator configured to convert the voltage signal into the timing signal.

18. The system of claim 13, wherein the acoustic signal is an amplitude modulated carrier signal, wherein the amplitude modulation is an on-off modulation, wherein shaped pulses are used to represent binary 1's.

19. The system of claim 18, wherein said pulses have a shape expressed by $[1-\cos(2\pi ft/)]/2$, $0 \leqq t < \tau$, when normalized, where f is the carrier frequency, $\tau$ is a pulse width, and m is a number of carrier frequency cycles in each pulse.

20. The system of claim 19 wherein m is an integer in an inclusive range between 4 and 14.

21. An acoustic telemetry system that comprises:

a tubing string having a free end and a fixed end;

an acoustic transmitter mounted on said tubing string at a selected position relative to said free end, wherein said acoustic transmitter is configured to generate an amplitude-modulated acoustic signal having a carrier frequency that propagates along the tubing string, wherein said selected position is selected from a set that consist of positions less than $\lambda/4$ away from said first end and positions approximately $n\lambda/2$ from said first end, where $\lambda$ is a wavelength associated with the carrier frequency and n is a positive integer less than two or a real number greater than the lesser of 4 times a number of cycles in a modulation toneburst and 40; and an acoustic receiver mounted on said tubing string at a second selected position relative to said second end, wherein said second selected position is selected from a second set that consist of positions approximately $(2k-1)\lambda/4$ from said second end, wherein k is a positive integer, wherein the acoustic receiver is configured to receive and demodulate the amplitude-modulated acoustic signal.

22. The system of claim 21, wherein the acoustic receiver includes:

an acoustic sensor configured to convert acoustic signals in said tubing string into a received signal;

a bandpass filter coupled to the acoustic sensor to receive the received signal, and configured to convert the received signal into a bandpass signal by blocking energy outside a desired frequency range;

a demodulator coupled to the bandpass filter to receive the bandpass signal, and configured to convert the bandpass signal into a baseband signal;

a detection module coupled to the demodulator to receive the baseband signal, and configured to convert the baseband signal into a detected symbol sequence, wherein the detection module includes:

an adaptive non-linear equalizer that operates on the baseband signal to minimize signal corruption and to render decisions that indicate a probable symbol sequence.

* * * * *